US006990983B1

(12) United States Patent
Lyman, Jr.

(10) Patent No.: US 6,990,983 B1
(45) Date of Patent: Jan. 31, 2006

(54) DISPOSABLE FOLDABLE CUP HOLDER ASHTRAY

(76) Inventor: Hugh Marion Lyman, Jr., 27639 SE. 401st St., Enumclaw, WA (US) 98022

( * ) Notice: Subject to any disclaimer, the term of this patent is extended or adjusted under 35 U.S.C. 154(b) by 19 days.

(21) Appl. No.: 11/135,545

(22) Filed: May 24, 2005

(51) Int. Cl.
*A24F 19/00* (2006.01)

(52) U.S. Cl. ..... 131/241; 131/240.1; 131/242; 131/231; 206/120; 206/496; 206/246

(58) Field of Classification Search ..... 206/271, 206/246, 496, 273, 120; 131/231, 238, 192, 131/24, 240.1, 242; 229/127
See application file for complete search history.

(56) References Cited

U.S. PATENT DOCUMENTS

| | | | | |
|---|---|---|---|---|
| 1,593,900 | A | | 7/1926 | Erikson |
| 1,614,265 | A | | 1/1927 | Stockton |
| 2,071,394 | A | | 2/1937 | Douelas |
| 2,152,285 | A | | 3/1939 | Schirmer |
| 2,158,770 | A | | 5/1939 | Bartlett |
| 2,291,753 | A | | 8/1942 | Patten |
| 2,432,056 | A | | 12/1947 | Cook |
| 2,506,962 | A | | 5/1950 | Madan |
| 2,714,464 | A | | 8/1955 | Cline |
| 2,796,067 | A | | 6/1957 | McCutcheon |
| 2,796,211 | A | | 6/1957 | Wagner |
| 2,836,340 | A | | 5/1958 | Crowley |
| 3,272,421 | A | * | 9/1966 | Perry ..... 299/185 |
| 3,342,317 | A | | 9/1967 | Barron |
| 3,364,937 | A | | 1/1968 | Dámaro |
| 3,371,845 | A | * | 3/1968 | Freiman ..... 229/247 |
| 3,401,702 | A | | 9/1968 | Rossman |
| 3,561,670 | A | | 2/1971 | Segal et al. |
| 3,620,225 | A | | 11/1971 | Bailey |
| 3,658,236 | A | * | 4/1972 | Ringholm et al. ..... 229/157 |
| 4,133,319 | A | | 1/1979 | Bloomfield |
| 4,187,864 | A | | 2/1980 | Taddeo |
| 4,634,014 | A | | 1/1987 | Carr |
| 4,726,472 | A | | 2/1988 | Su |
| 4,896,825 | A | | 1/1990 | Moeller |
| D307,947 | S | | 5/1990 | Wells et al. |
| 5,016,754 | A | | 5/1991 | Gilda et al. |
| 5,090,571 | A | * | 2/1992 | Walker ..... 206/523 |
| 5,370,138 | A | | 12/1994 | Mou |
| 5,673,709 | A | | 10/1997 | Brothers |
| D401,009 | S | | 11/1998 | Hicaro, Jr. et al. |
| D403,804 | S | | 1/1999 | Silkaitis |
| 5,996,588 | A | | 12/1999 | Abrines Amer |

* cited by examiner

*Primary Examiner*—Dionne A. Walls
*Assistant Examiner*—Carmen Lyles-Irving

(57) ABSTRACT

A disposable, portable, pocketable, foldable and reusable cigarette ashtray which is formed from a single blank of fire retardant paper or other suitable material into a box shape that will fit into a vehicle cup holder. The ashtray consists of four sides, a bottom, three cavity leaf panels and a folding top lid. The cavity leaf panels slope into the container forming upper and lower cavities. When the ashtray is full of cigarette butts, a top lid panel is folded over the top cavity, locked in place and then safely disposed of. The back panel is supplied with an adhesive strip for attaching the ashtray to a surface. The ashtray is sized to act as a package for two packs of cigarettes. It is inexpensive to produce and can be folded for convenient packaging and portability.

3 Claims, 5 Drawing Sheets

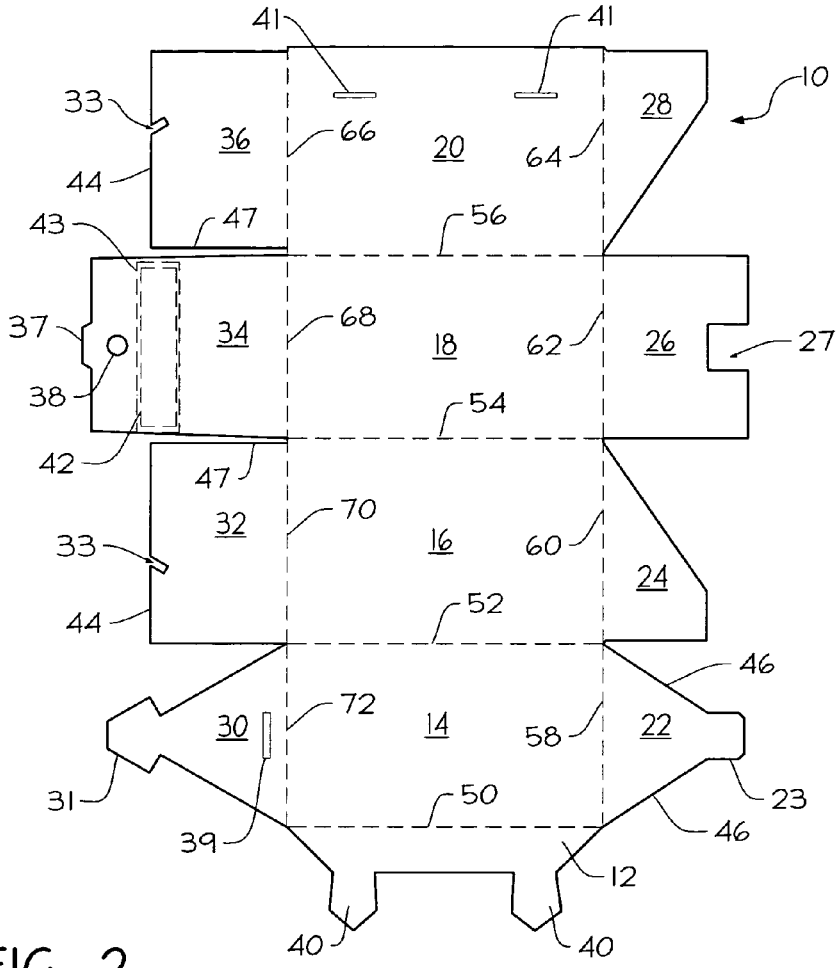
FIG. 1
FIG. 2
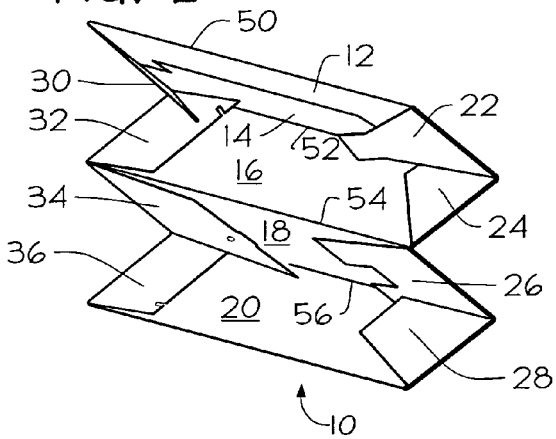
FIG. 3
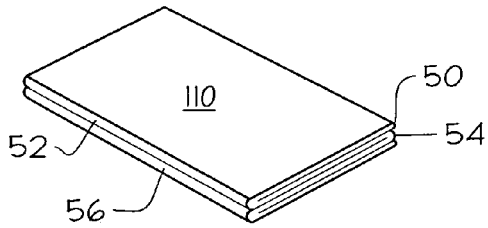

DISPOSABLE FOLDABLE CUP HOLDER ASHTRAY

FIELD OF INVENTION

The present invention relates to ashtrays and, more particularly, to an ashtray that is formed from a single blank, and that is disposable, portable, pocketable and foldable, being sized for use in vehicle cup holders and that can also be attached to any surface and placed on table tops.

BACKGROUND OF THE INVENTION

Discarding cigarette butts from vehicles is an expensive violation of state laws, yet many smokers continue to disregard these laws. In campsites there always seem to be cigarette butts littered around campfires and gathering places. No ashtrays are normally furnished in golf carts; thus cigarette butts are too often seen littered around tees and greens. Many vehicle ashtrays are difficult to remove for cleaning and many are so small that ashes and butts are often spilled therefrom. Many vehicle owners who smoke prefer not to use their vehicle ashtrays as the burning cigarettes and cigars stain the ashtray interior finish which they feel may decrease the value of the vehicle for resale. With state laws increasingly limiting smoking in buildings, more smokers are forced to smoke outside, increasing the potential for littering. Therefore to help preserve the environment, there is a need for an ashtray that is disposable, portable, pocketable and foldable, that fits a vehicle cup holder, that can be mounted to objects, that is simple to assemble, easy to carry and inexpensive so smokers will not hesitate to use them.

Prior art discloses many designs of ashtrays that are considered disposable, portable, pocketable and/or foldable. Some will conveniently fit into a vehicle cup holder. Some are made from a single blank. A matrix of prior art is extensive. Therefore, mentioned herein are only a few ashtray inventions that include some of the desired attributes.

U.S. Pat. No. 2,071,394 to Douglas, U.S. Pat. No. 2,796,067 to McCutcheon, and U.S. Pat. No. 3,561,670 to Segal et al are all formed from a single blank and are considered disposable, portable, pocketable and foldable. However, these inventions are not adequately designed to rest in a vehicle cup holder and McCutcheon and Segal et al are not for table top use.

U.S. Pat. No. 4,634,014 to Carr is formed from a single blank, is disposable, portable and will work in a vehicle cup holder only if the user has an opened beverage can.

U.S. Design Pat. No. 307,947 to Wells et al, Pat. No. Des. 401,009 to Hicaro et al and Pat. No. Des. 403,804 to Silkaitis are cup holder ashtrays, but are not foldable and pocketable.

Heretofore, no prior art addresses a cup holder ashtray that will conveniently fit in a vehicle cup holder that is disposable, portable, pocketable, foldable, un-foldable, reusable, simple and economically inexpensive to fabricate from a single blank. Neither can any prior art ashtray be furnished to the smoker as a packaging box with multiple packs of cigarettes or packaged folded with a single package of cigarettes, or carried folded in a shirt pocket or a purse and mountable to a variety of objects.

For purposes of brevity the disposable foldable cup holder ashtray of this invention will be referred to as an "ashtray".

It is therefore an object of the invention to provide an ashtray that is disposable, portable, pocketable, foldable, and reusable.

It is another object of the invention to provide an ashtray that fits into a vehicle cup holder.

It is another object of the invention to provide an ashtray that can be made available to the smoker as a package for multiple packs of cigarettes.

It is another object of the invention to provide an ashtray that will fold to a size that can be packaged with a single pack of cigarettes and carried in a shirt pocket or a purse.

It is another object of the invention to provide an ashtray that is simple, easy and quick to assemble.

It is another object of the invention to provide an ashtray that can be folded and packaged flat with a plurality of folded ashtrays packaged for marketing.

It is another object of the invention to provide an ashtray that is inexpensive.

It is another object of the invention to provide an ashtray that can be fabricated from a single blank.

SUMMARY OF THE INVENTION

In accordance with the present invention, there is provided an ashtray that is both functional and convenient. The ashtray is formed from a single sheet of fire retardant paper or other suitable material into a box shape of a size that will fit into a vehicle cup holder, fold flat to a size that will fit in a shirt pocket or a purse, be used for packaging multiple packs of cigarettes and packaged single with a pack of cigarettes. The ashtray can be mounted in a variety of places, be reused, unfolded and conveniently disposed of. The invention is sized to hold the cigarette butts from many packs of cigarettes and accommodate different size packs of cigarettes when used for packaging full packs of cigarettes. When pre-assembled as a package for multiple packs of cigarettes it can be unfolded for convenient portability. The ashtray comprises four sides, a bottom assembly, a folding top closure panel, three top sloping leaf panels for forming a top cavity and a bottom cavity. The top leaf panels slope in from the top opening forming the top cavity for resting a burning cigarette. A space between the edges of the leaf panels allows ashes to fall to the ashtray bottom cavity and also will hold a cigarette butt between the edges of the side leaf panels until it extinguishes and is pushed into the lower cavity. The space will not allow extinguished butts to fall out of the ashtray and minimizes the likelihood of ashes falling out if it is overturned. When the ashtray is full of cigarette butts, the folding top closure lid panel is folded over the top cavity and latched in place with the top lid tab which inserts into the slot aperture provided in the front top leaf panel. The inventive ashtray can then be safely disposed of without fear of spilling its contents. The ashtray can also be reused by unfolding the top leaf panels and emptying the contents, then refolding the top leaf panels. The ashtray is provided with a mounting pad for mounting to any surface and a hole in the top lid for hanging on hook or nail.

BRIEF DESCRIPTION OF THE DRAWINGS

A complete understanding of the present invention may be obtained by reference to the accompanying drawings, when considered in conjunction with the subsequent, detailed description, in which:

FIG. 1 is an unfolded flat view of a single blank for forming the ashtray, in accordance with this invention;

FIG. 2 is a process folding view of the ashtray blank folding into position for packaging;

FIG. 3 is a perspective view of the folded ashtray;

For purposes of clarity and brevity, like elements and components will bear the same designations and numbering throughout the FIGURES.

DESCRIPTION OF THE PREFERRED EMBODIMENT

Figure 4:
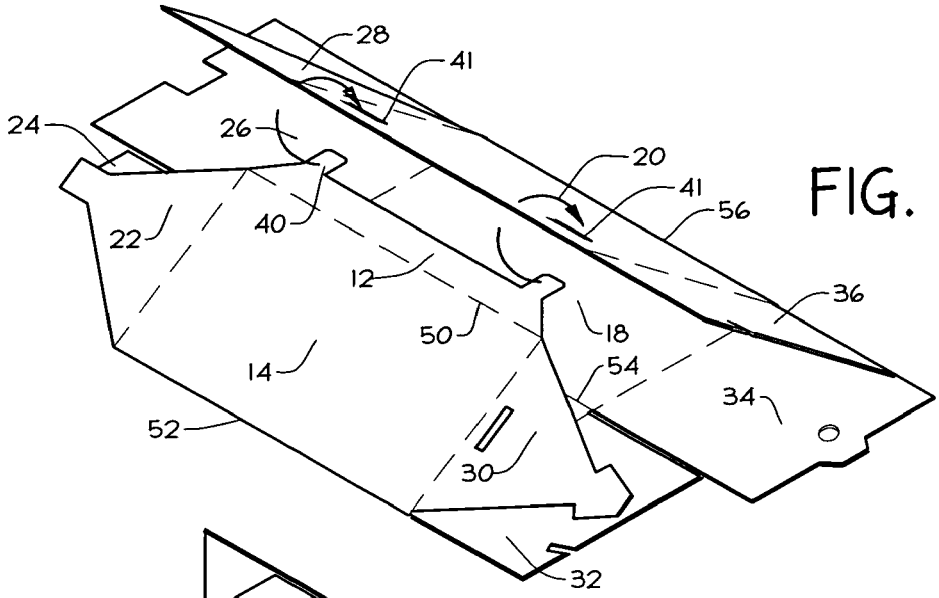
FIG. 4 is a process folding view of the ashtray illustrating the first step in assembling the ashtray.

Generally speaking, the invention comprises an ashtray that is formed from a single flat blank of material that can be conveniently folded into an ashtray of a size that fits into a vehicle cup holder. The assembled ashtray can be used for packaging multiple packs of cigarettes or packaged folded with a single pack of cigarettes. It is disposable, portable, pocketable, foldable, reusable and inexpensive to fabricate. The box shape of the inventive ashtray may be either square or rectangular.

Now referring to FIG. 1, there is shown a unfolded view of a flat single blank 10 for forming an ashtray 100 (FIGS. 13–15), in accordance with this invention. The ashtray blank 10 is die cut or stamped out and scored with fold lines from a single sheet of fire resistant paper or other suitable web material. Panel fold lines are creases for forming the ashtray box shape from the single flat blank 10. The embodiments of the invention include a front panel 14, front panel flap 12, right side panel 16, back panel 18, left side panel 20, first bottom flap panel 22, second bottom flap panel 24, third bottom flap panel 26, fourth bottom flap panel 28, front leaf cavity panel 30, right cavity leaf panel 32, left cavity leaf panel 36 and a top lid panel 34, all as outlined by the panel fold lines 50 through 72. The front panel flap 12 is provided with two tabs 40 that insert into respective tab slot apertures 41 in the left side panel 20 when forming the ashtray. The front cavity leaf panel 30 is also provided with a slot aperture 39 to receive the top lid tab 37 which is permanently affixed to the top lid 34.

Referring to FIG. 2, the folding process is shown for folding the ashtray blank into a flat packet, as shown in FIG. 3. The panels 12, 22, 24, 26, 28, 30, 32, 34 and 36 are all folded in toward the center of the blank 10 at fold lines 50, 58, 60, 62, 64, 72, 70, 68 and 66, respectively. Panels 14 and 20 are folded forward at fold lines 52 and 56 toward panels 16 and 18, respectively. Folded panels 14 and 16 are folded backwards at fold line 54 toward folded panels 18 and 20. Compressing the folded panels flat presents a small packet ready for packaging, transporting or storage. In this folded position the folded ashtray 100 can be carried conveniently in a shirt pocket or a purse.

Referring to FIG. 3, one folded flat ashtray 110 is illustrated ready for packaging. The illustration of the folded ashtray blank 110 as shown is a representation of a square shape ashtray. A rectangular shaped ashtray can also be produced and will fold the same way as the square shaped ashtray, but will be a wider packet by twice the difference between the shorter front and back panels 14, 18 and the longer side panels 16, 20. The square size ashtray 100 is ideal for ashtrays that are packaged with a single pack of cigarettes and for packing in plurality without packs of cigarettes. The rectangular shape ashtray is required for packaging multiple packs of cigarettes.

Figure 5:
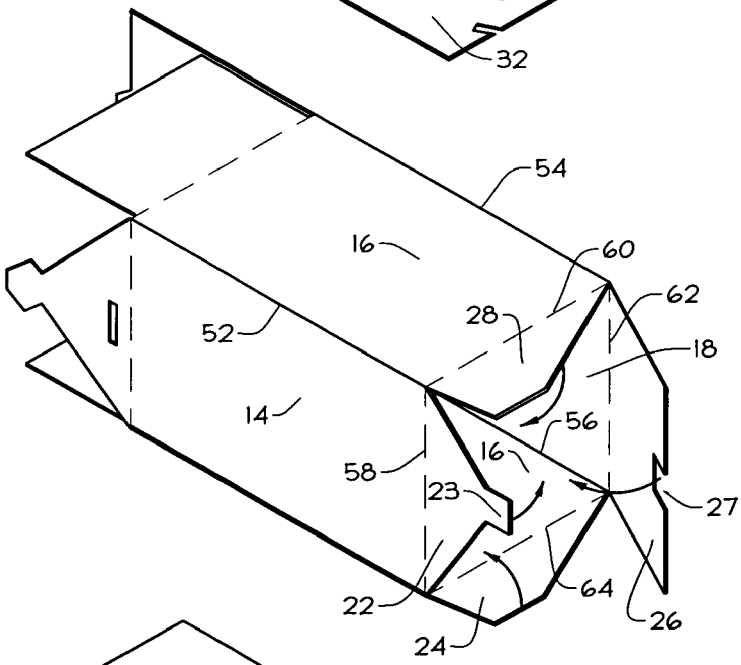
FIG. 5 is a process folding view of the bottom of the ashtray, folding the panels that form the bottom of the ashtray.

Referring to FIG. 4, a process folding view is shown of the first step for assembling the ashtray 100 from the flat blank 10 or the unfolded packet. The front panel 14 is folded over the right side panel 16, at fold line 52. The left side panel 20 is next folded over the back panel 18, at fold line 56. The front panel flap 12 is folded at fold line 50 and the flap tabs 40 are inserted into the left side panel slot apertures 41 in the left side panel 20. This process is facilitated by partly folding the right side panel 16 and the back panel 18 at fold line 54. The flap tabs 40 are folded back toward the left side panel 20 which secures the connection between the front panel 14 and the left side panel 20. The body of ashtray 100 is then shaped into a rectangular box design as shown in FIG. 5 by squeezing the assembly corners together at the fold lines 52 and 56. Fold lines 50, 52, 54 and 56 become the corners of the ashtray 100.

Referring to FIG. 5, a process folding view of the inventive ashtray 100 illustrates assembling the bottom, as is well known in the art. The bottom third flap panel 26 is first folded into the ashtray 100 bottom opening at fold line 62. Second bottom flap panel 24 is folded into the ashtray 100 bottom opening at fold line 64 and fourth bottom flap panel 28 is next folded into the bottom ashtray 100 opening at fold line 60. First bottom flap panel 22 is last folded into the ashtray 100 box bottom opening at fold line 58 aligning and tucking the first bottom flap tab 23 into the third bottom flap notch 27.

Figure 6:
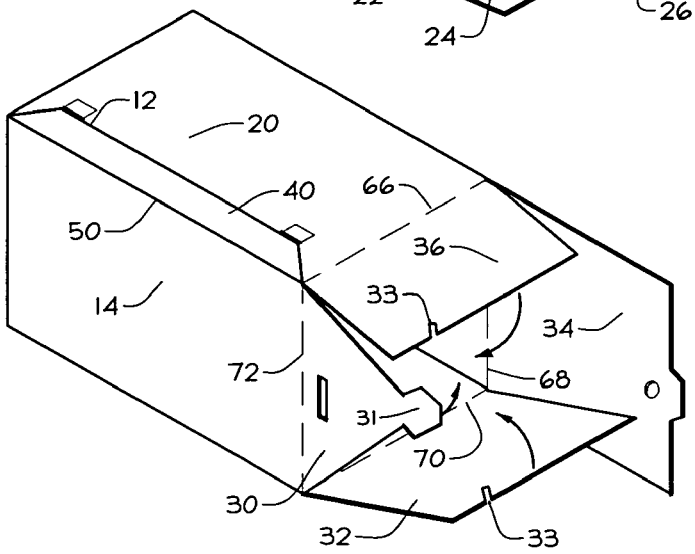
FIG. 6 is a process folding view of the top of the ashtray, folding the top cavity leaf panels.

Referring to FIG. 6, illustrates the three cavity leaf panels 30, 32, 36 beginning to fold. The right and left cavity leaf panels 32 and 36, respectively, are first folded into the top opening at fold lines 70 and 66 respectively. The front cavity leaf panel 30 is then folded into the top opening at fold line 72 spreading the right and left cavity panels 32 and 36 apart until the front cavity leaf panel tab 31 engages the right and left cavity leaf panel notches 33, thus latching the three leaf panels 30, 32, 36 in position.

Figure 7:
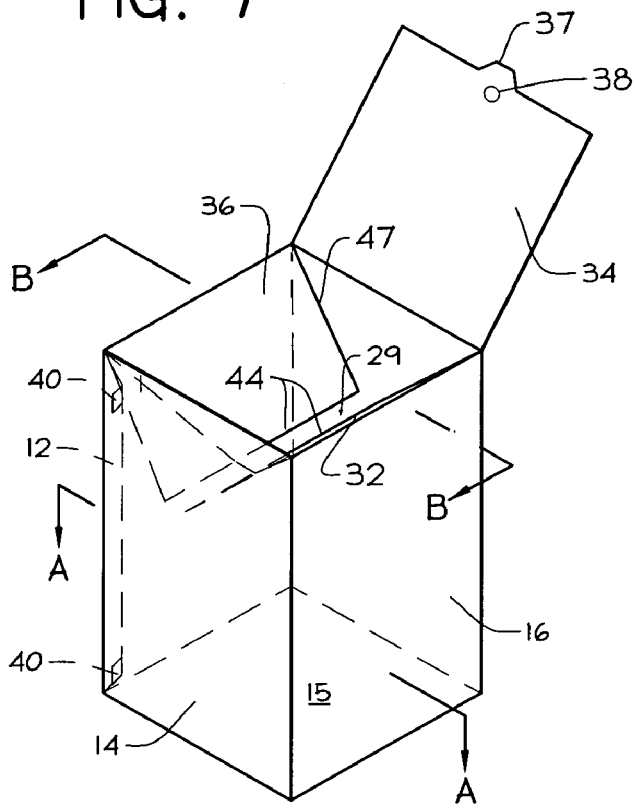
FIG. 7 is a perspective front view of the assembled ashtray.
Figure 8:
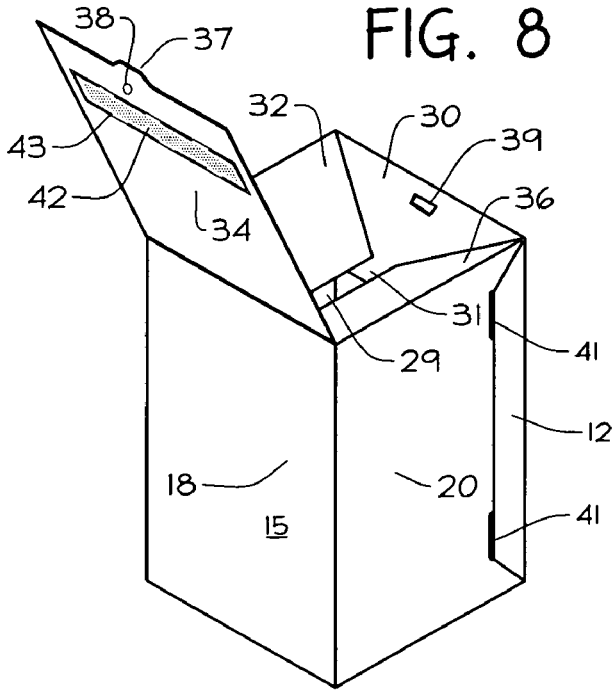
FIG. 8 is a perspective back view of the assembled ashtray.
Figure 9:
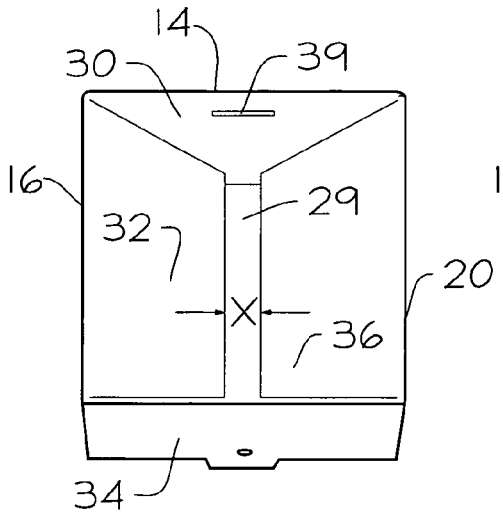
FIG. 9 is a top view of the ashtray.
Figure 11:
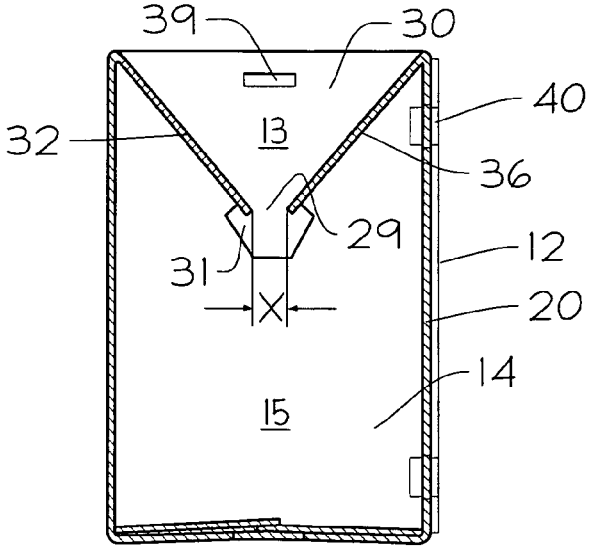
FIG. 11 is a cross sectional view of the assembled ashtray taken along FIG. 7 lines B—B, illustrating the position of the top folding leafs that form the top and bottom cavities.

Referring to FIG. 7 and FIG. 8, perspective front and back views are shown, respectively, of the ashtray 100 in accordance with this invention, illustrating the left and right cavity leaf panels 32 and 36 held in position with the respective front cavity leaf panel 30. These leaf panels 32, 36 form a top cavity 13 sloping toward a bottom cavity 15 as shown in FIG. 11. The back side edges 47 of the left and right cavity panels 32 and 36 are free to flex. A space or opening 29 between the right and left cavity leaf panel edges 44 is maintained for ashes 83 (FIG. 13) to fall into the bottom cavity 15. The dimension "X" of the space 29 as shown in FIG. 9 allows the bottom edges 44 of the cavity leaf panels 32 and 36 to hold a cigarette butt 84 until it is pushed into the bottom cavity 15. Sufficient flex in the leaf panels 32 and 36 allows cigars and cigarettes of varying diameter to be held in position between the leaf edges 44. Dimension "X" will not allow cigarette butts 84 to escape from the bottom cavity 15 and minimizes ashes 83 from falling out of the bottom cavity 15 if the ashtray 100 is overturned.

Shown in FIG. 8 is an adhesive strip 42 applied to the top of the top lid 34 and covered with a peel off tape 43, as is well known in the art. Further, it is evident by anyone skilled in the art that the adhesive strip 42 may also be applied to any of the panels 14, 16, 18 and 20. By removing the peel off tape 43, the ashtray 100 can be mounted to any surface such as the edge of a park bench 88. Additionally, the top lid 34 is provided with a punched hole 38 for hanging the ashtray 100 on a hook or a nail. Slot 39 in the front cavity leaf panel 30 receives the top lid tab 37 when the lid 34 is closed.

Dimension "X" shown in FIG. 9 is a critical dimension for opening 29 to hold a burning cigarette 82 from falling out of the ashtray 100 while resting. A cigarette butt 84 that is still burning can be held therein so it can extinguish prior to being deposited in the lower cavity 15.

Figure 10:
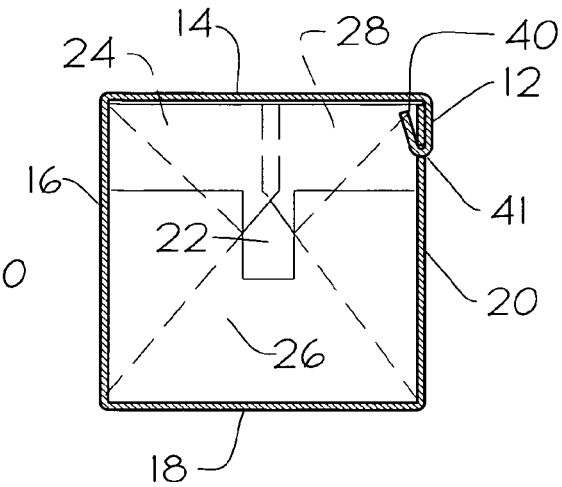
FIG. 10 is a cross sectional view of the assembled ashtray taken along FIG. 7 lines A—A.

Referring to FIG. 10, a cross sectional view of ashtray 100 is shown taken along lines A—A (FIG. 7) after the ashtray 100 has been assembled, illustrating the four bottom panels 22, 24, 26 and 28 in their interlocked position. The bottom of pre-assembled ashtray 100 for packaging multiple packs of cigarettes can be formed from different designs, as is well known to anyone skilled in the art.

Referring to FIG. 11, a cross sectional view of the invention is shown taken along lines B—B (FIG. 7) after the ashtray 100 has been assembled illustrating the sloped position of the cavity leaf panels 30, 32 and 36 forming the top and bottom cavities 13 and 15 along with the slot 39 in the front cavity leaf panel 30.

Figure 12:
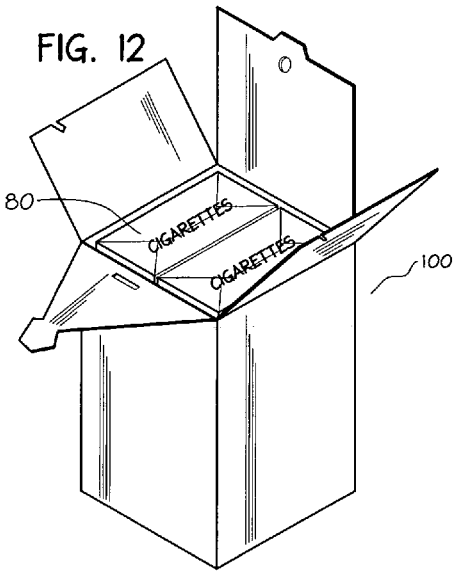
FIG. 12 is a perspective top view of the ashtray, with two packs of cigarettes placed in the ashtray package ready for sealing.

Referring to FIG. 12, a perspective front view of the assembled inventive ashtray 100 is shown illustrating two packs of cigarettes 80 placed in the ashtray body or box ready for sealing. The size of the ashtray 100 is determined by the size of the cigarette packs 80 along with the size of vehicle cup holders 86. It will be apparent to anyone skilled in the art that the size of the ashtray 100 may vary depending on any change in the cigarette pack 80 size and the size of the vehicle cup holder 86.

Figure 13:
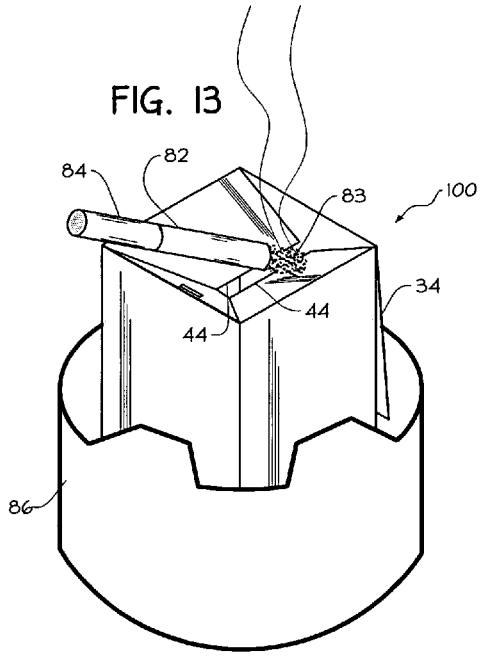
FIG. 13 is a perspective top view of the ashtray, positioned in a vehicle cup holder and having a burning cigarette resting in the ashtray.

Referring to FIG. 13, a perspective front view of this invention shows the ashtray 100 placed in a vehicle cup holder 86 with a burning cigarette 82 resting in the top cavity 13. The burning cigarette 82 can be placed in the ashtray 100 with the burning end 83 pushed into the space 29 and there held by the right and left cavity leaf panel edges 44 until retrieved by the user, thus avoiding the risk of the burning cigarette 82 falling out of the ashtray 100 as it burns down to the butt 84.

Figure 14:
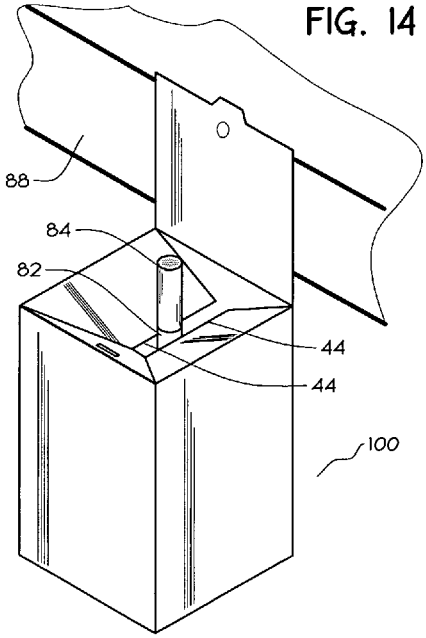
FIG. 14 is a perspective top view of the ashtray, attached to a bench edge with a cigarette butt being deposited into the lower cavity of the ashtray.

Referring to FIG. 14, a perspective front view of the ashtray 100 is shown attached to a bench edge 88 with a cigarette butt 84 held between the left and right cavity leaf panel edges 44 ready to be pushed into the bottom cavity 15.

Figure 15:
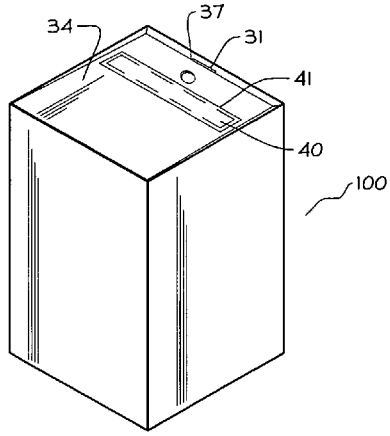
FIG. 15 is a perspective top view of the ashtray, with the top closure lid closed ready for disposal.

Referring to FIG. 15, a perspective top view of the ashtray 100 is shown with the top lid 34 closed and the top lid tab 37 inserted into the front cavity leaf panel slot aperture 39. The ashtray 100 as shown is ready for disposal.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A fire-resistant foldable ashtray comprising: a plurality of fire resistant panels and flaps foldably connected at respective fold lines in the shape of a box defining a cavity; front, right and left cavity leaf panels, wherein the right and left cavity leaf panels define a top portion of the cavity sloping toward a bottom portion of the cavity, said front cavity leaf panel being folded into a top opening spreading the right and left cavity leaf panels apart such that a tab of the front cavity leaf panel engages notches in the right and left cavity leaf panels thus latching all three cavity leaf panels into position;

a space disposed between the edges of the cavity leaf panels allowing ashes to fall to the bottom portion of the cavity, and allowing a cigarette butt to be held until it extinguishes and is pushed into the bottom portion of the cavity;

and a top lid foldably connected at a fold line to one of said plurality of panels.

2. An ashtray in accordance with claim 1, wherein said top lid comprises an aperture so said ashtray is capable of being hung on a hook.

3. An ashtray in accordance with claim 1, wherein an adhesive strip is attached to the top of said lid.

* * * * *